US007239288B2

(12) United States Patent
Lynch et al.

(10) Patent No.: US 7,239,288 B2
(45) Date of Patent: Jul. 3, 2007

(54) ACCESS POINT ANTENNA FOR A WIRELESS LOCAL AREA NETWORK

(75) Inventors: Michael J. Lynch, Merritt Island, FL (US); Bing Chiang, Melbourne, FL (US)

(73) Assignee: IPR Licensing, Inc., Wilmington, DE (US)

( * ) Notice: Subject to any disclaimer, the term of this patent is extended or adjusted under 35 U.S.C. 154(b) by 0 days.

(21) Appl. No.: 10/953,893

(22) Filed: Sep. 29, 2004

(65) Prior Publication Data

US 2005/0088359 A1 Apr. 28, 2005

Related U.S. Application Data

(60) Provisional application No. 60/507,330, filed on Sep. 30, 2003.

(51) Int. Cl.
*H01Q 19/10* (2006.01)

(52) U.S. Cl. ..... 343/833; 343/853

(58) Field of Classification Search ..... 343/700 MS, 343/833, 834, 853
See application file for complete search history.

(56) References Cited

U.S. PATENT DOCUMENTS 3,846,799 A 11/1974 Gueguen ..... 343/833
5,905,473 A 5/1999 Taenzer ..... 343/834
6,127,987 A * 10/2000 Maruyama et al. ..... 343/835

OTHER PUBLICATIONS

Cushcraft Catalog, 2400-2500 MHz, Squint Ceiling Mount Omnidirectional Antennas, Apr. 22, 2002, available at www.cushcraft.com.
Ohira et al., Electronically Steerable Passive Array Radiator Antennas for Low-Cost Analog Adaptive Beamforming, 0-7803-6345-0/00, 2000, IEEE.
Scott et al., Diversity Gain From a Single-Port Adaptive Antenna Using Switched Parasitic Elements Illustrated with a Wire and Monopole Prototype, IEEE Transactions on Antennas and Propagation, vol. 47, No. 6, Jun. 1999.
King, The Theory of Linear Antennas, pp. 622-637, Harvard University Press, Cambridge, Mass., 1956.
Lo et al., Antenna Handbook: Theory, Applications and Design, pp. 21-38, Van Nostrand Reinhold Co., New York, 1988.

* cited by examiner

*Primary Examiner*—Michael C. Wimer
(74) *Attorney, Agent, or Firm*—Allen, Dyer, Doppelt, Milbrath & Gilchrist, P.A.

(57) ABSTRACT

An access point antenna for a wireless local area network (WLAN) includes a combiner network with a feed point, a ground plane adjacent the combiner network, and a dielectric substrate adjacent the ground plane. Conductive paths are on the dielectric substrate and are coupled to the feed point. Active antenna elements extend from the dielectric substrate. Each active antenna element is coupled to a respective conductive path and is equally spaced from a common area on the dielectric substrate. A passive director antenna element extends from the dielectric substrate and is coupled to the ground plane adjacent the common area.

40 Claims, 6 Drawing Sheets

ACCESS POINT ANTENNA FOR A WIRELESS LOCAL AREA NETWORK

RELATED APPLICATION

This application claims the benefit of U.S. Provisional Application Ser. No. 60/507,330 filed Sep. 30, 2003, the entire contents of which are incorporated herein by reference.

FIELD OF THE INVENTION

The present invention relates to the field of wireless local area networks (WLAN), and more particularly, to an access point antenna for a WLAN.

BACKGROUND OF THE INVENTION

A wireless local area network (WLAN) includes a distribution system in which spaced-apart access point antennas are connected thereto via wired connections. Each access point antenna has a respective zone for transmitting and receiving radio frequency (RF) signals with client stations in their corresponding zone. The client stations are supported with wireless local area network hardware and software to access the distribution system.

A typical access point antenna is a standard monopole antenna. This type of access point antenna provides omni-directional coverage with a gain of about 2 dBi over a frequency range of 2.3 to 2.5 GHz. While omni-directional coverage is desirable, an antenna gain of 2 dBi limits the range in which the client stations can be separated from the access point antenna and still exchange RF signals therebetween.

As an alternative to the standard monopole access point antenna, Cushcraft™ provides a ceiling mounted access point antenna with omni-directional coverage having a gain of 3.5 dBi. The Cushcraft™ antenna is also a monopole antenna but larger in size.

The antenna gain can be further increased without increasing the size of the access point antenna if the antenna coverage becomes directional instead of omni-directional. That is, a high antenna gain is provided in a fixed direction. However, antenna gains outside the fixed direction are low.

SUMMARY OF THE INVENTION

In view of the foregoing background, it is therefore an object of the present invention to provide an access point antenna with an improved antenna gain while still providing omni-directional coverage.

This and other objects, features, and advantages in accordance with the present invention are provided by an access point antenna for a wireless local area network (WLAN) comprising a combiner network including a feed point, a ground plane adjacent the combiner network, and a dielectric substrate adjacent the ground plane.

A plurality of conductive paths are on the dielectric substrate and are coupled to the feed point. A plurality of active antenna elements extend from the dielectric substrate, with each active antenna element being coupled to a respective conductive path and being equally spaced from a common area on the dielectric substrate. A passive director antenna element extends from the dielectric substrate and is coupled to the ground plane adjacent the common area.

The active antenna elements and the passive director antenna element may be sized and spaced apart from one another so that the access point antenna has a gain within a range of 3.5 to 5.0 dBi. In addition, the passive director antenna element may be centered about the common area so that the access point antenna provides omni-directional coverage. The access point antenna in accordance with the present invention advantageously provides high gain with omni-directional coverage, which allows the antenna to be remotely mounted while supporting a WLAN, particularly within an office environment.

The combiner network may be centered about the common area so that a distance between the combiner network and each respective active antenna element is the same. In this embodiment, the plurality of conductive paths extend radially from the combiner network, and a length of each conductive path is equal to the length of the other conductive paths so that the phase of the RF signals received by the combiner network from the conductive elements are the same, as well as being the same for RF signals received by the conductive antenna elements from the combiner network.

Alternatively, the combiner network may be off-centered about the common area so that a distance between the combiner network and each respective active antenna element is different. In this embodiment, a length of each conductive path is also equal to the length of the other conductive paths so that the phase of the RF signals received by the combiner network from the conductive elements are the same, as well as being the same for RF signals received by the conductive antenna elements from the combiner network.

The active antenna elements may be angularly spaced from the common area at equal angles. The active antenna elements may be arranged as opposing pairs about the common area, and the passive director antenna element may bisect angles of the opposing pairs of active antenna elements.

The passive director antenna element and each active antenna element may be orthogonal to the dielectric substrate. Each active antenna element may comprise a blade antenna element oriented along a radius thereof toward the common area.

The active antenna elements may be sized so that the access point antenna is operable over a frequency range of 2.3 to 2.5 GHz. Alternatively, the active antenna elements may be sized so that the access point antenna is operable over a frequency range of 4 to 6 GHz. The dielectric substrate may comprise a printed circuit board. The conductive paths may comprise microstrips or co-planar waveguides.

Another aspect of the present invention is directed to a method for making an antenna as described above. The method comprises forming a ground plane adjacent a combiner network, with the combiner network including a feed point, and forming a dielectric substrate adjacent the ground plane. A plurality of conductive paths are formed on the dielectric substrate, and are coupled to the feed point. The method further comprises extending a plurality of active antenna elements from the dielectric substrate, and coupling each active antenna element to a respective conductive path so that each active antenna element is equally spaced from a common area on the dielectric substrate. A passive director antenna element also extends from the dielectric substrate, and is coupled to the ground plane adjacent the common area.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
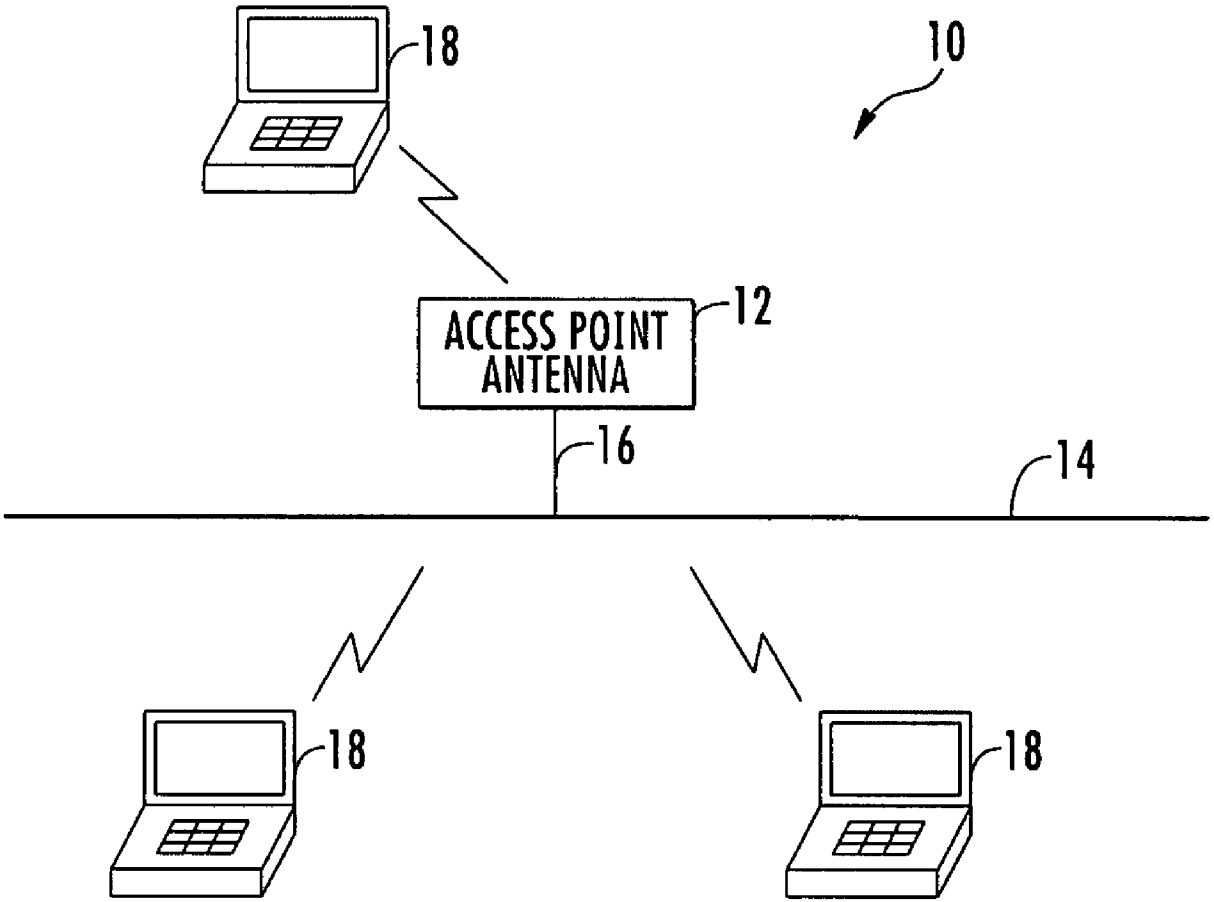
FIG. 1 is a schematic diagram of a wireless local area network including an access point antenna in accordance with the present invention.

An example wireless local area network 10 including an access point antenna 12 will now be discussed with reference to FIG. 1. The illustrated access point antenna 12 is connected to a distribution system 14 via a wired connection 16. The access point antenna 12 has omni-directional coverage in which it is capable of transmitting and receiving RF signals with the client stations 18.

In the WLAN 10, the access point antenna 12 uses a traditional 2.4 GHz carrier frequency 802.11 protocol, including 802.11b and 802.11g. Depending on the intended application and corresponding protocol, the access point antenna 12 may be designed to operate at different frequencies, such as 5 GHz for 802.11a, as readily appreciated by those skilled in the art.

Access point antennas 12 in general may be mounted in a variety of positions. They may, for example, be mounted vertically on a wall, horizontally on a shelf, or from a ceiling 15. When an access point antenna 12 is ceiling mounted, the peak of the antenna pattern is tilted away from the ground plane 22. That is, a ceiling mounted access point antenna 12 results in a down tilt to radiate more efficiently toward the client stations 18.

Figure 2:
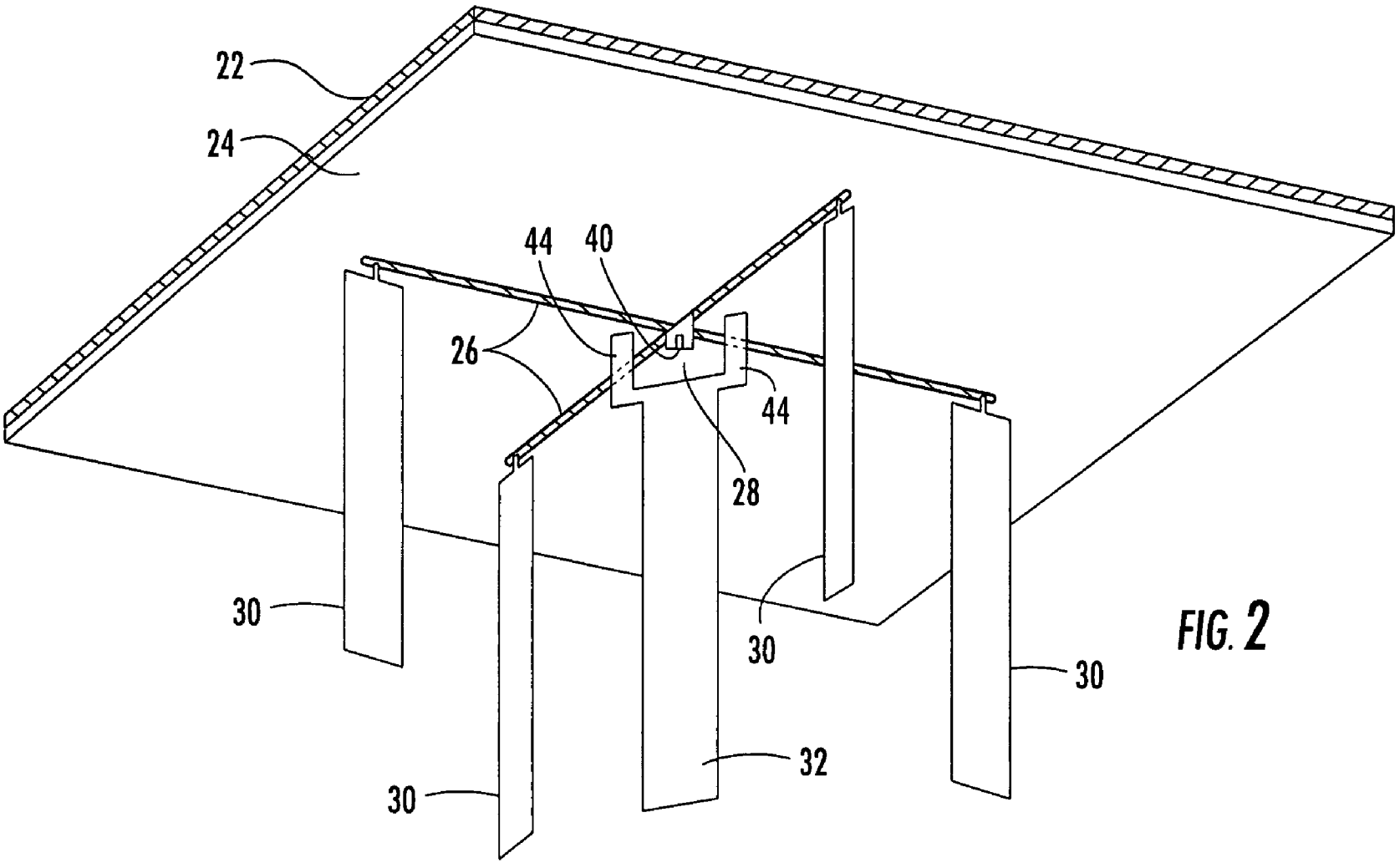
FIG. 2 is a perspective view of one embodiment of a ceiling mounted access point antenna without the radome in accordance with the present invention.
Figure 3:
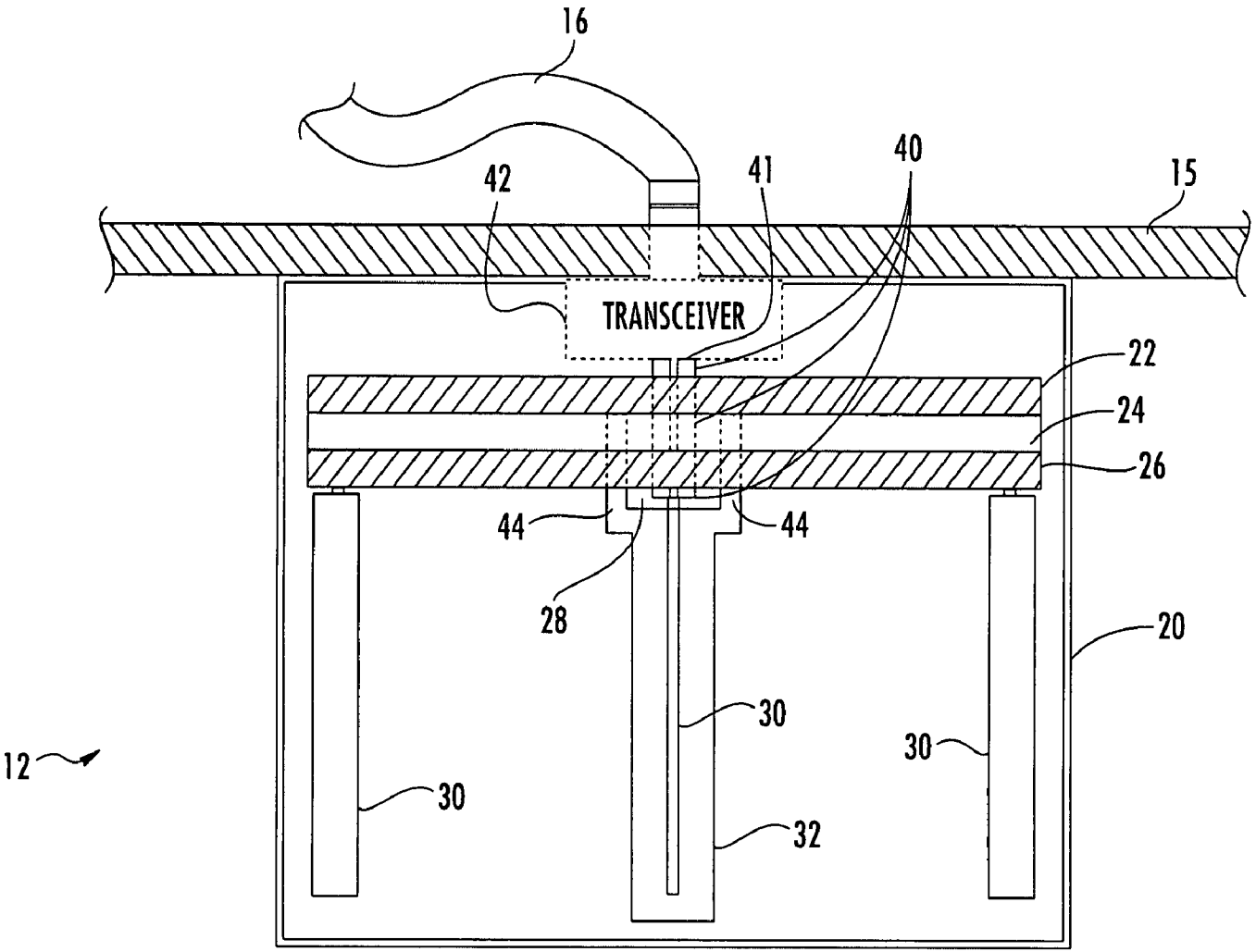
FIG. 3 is a cut-away side view of the ceiling mounted access point antenna shown in FIG. 2.

Referring now to FIGS. 2 and 3, the access point antenna 12 comprises a combiner network 40 including a feed point 41, and a ground plane 22 is adjacent the combiner network. A dielectric substrate 24 is adjacent the ground plane 22. A plurality of conductive paths 26 are on the dielectric substrate 24 and are coupled to the feed point 41.

A plurality of active antenna elements 30 extend from the dielectric substrate 24. Each active antenna element 30 is coupled to a respective conductive path 26 and is equally spaced from a common area 28 on the dielectric substrate 24. A passive director antenna element 32 extends from the dielectric substrate 24 and is coupled to the ground plane 22 adjacent the common area 28. A microwave transparent enclosure or radome 20 encloses the active antenna elements 30 and the passive director antenna element 32.

The dielectric substrate 24 may be a printed circuit board and the conductive paths 26 may be formed of copper, for example. The conductive paths may be microstrips, co-planar waveguides or co-planar waveguides with a ground plane as readily appreciated by those skilled in the art.

The combiner network 40 as illustrated in FIGS. 2 and 3 is centered about the common area 28 so that a distance between the combiner network and each respective active antenna element 30 is the same. In this embodiment, the conductive paths 26 extend radially from the combiner network 40, and a length of each conductive path is equal to the length of the other conductive paths. The lengths of the conductive paths 26 are equal so that the phase and amplitude of the RF signals received by the combiner network 40 from the conductive elements 30 are the same, as well as being the same for RF signals received by the conductive antenna elements from the combiner network.

The active antenna elements 30 and the passive director antenna element 32 are sized and spaced apart from one another so that the access point antenna has a gain within a range of 3.5 to 5.0 dBi. In addition, the passive director antenna element 32 is centered about the common area 28 so that the access point antenna 12 provides omni-directional coverage. The passive director antenna element 32 directs the RF energy from each of the active antenna elements 30 away from the common area 28. The access point antenna 12 in accordance with the present invention advantageously provides a high antenna gain with omni-directional coverage, which allows the access point antenna to be remotely mounted while supporting a WLAN 10, particularly within an office environment.

The illustrated active antenna elements 30 and the passive antenna element 32 are orthogonal to the dielectric substrate 24. However, the elements 30, 32 may also extend outwardly from the dielectric substrate 24 at an angle other than 90 degrees, as readily appreciated by those skilled in the art.

The access point antenna 12 may also function as a repeater when the feed point 41 of the combiner network is connected to a transceiver 42, as illustrated in FIG. 3. The transceiver 42 then interfaces with the wired connection 16 that is connected to the distribution system 14 of the WLAN 10.

In the illustrated access point antenna 12, there are 4 active antenna elements 30 spaced at 90 degree intervals on the dielectric substrate 24. Each illustrated active antenna element 30 comprises a blade antenna element oriented along a radius thereof toward the common area 28. The actual number of active antenna elements 30 may vary depending on the intended application and the desired gain, as readily appreciated by those skilled in the art.

As noted above, the conductive paths 26 may extend radially from the common area 28 so that the active antenna elements 30 are radially spaced from the common area at equal distances. The active antenna elements 30 may also be angularly spaced from the common area 28 at equal angles. The active antenna elements 30 may also be arranged as opposing pairs about the common area 28 so that the passive director antenna element 32 bisects angles of the opposing pairs of active antenna elements. The illustrated passive director element 30 sits on top of a "bridge" portion 44 that provides an opening over the common area 28 as well as being connected to the ground plane 22.

The active antenna elements 30 and the passive director antenna element 32 are sized so that the access point antenna 12 operates over the frequency range of 2.3 to 2.5 GHz. A size of the access point antenna 12 operating at this frequency and gain has a height of 2.5 inches or less, and a diameter of 6 inches or less. Of course the frequency range, size and gain of the access point antenna 12 may vary depending on the intended application. For instance, the elements 30, 32 may be sized so that the access point antenna 12 operates over a frequency range of 4 to 6 GHz, for example.

The desired output impedance from the combiner network 40 is typically 50 ohms. The combiner network 40 matches the impedance of the conductive paths 26 so that there is 50 ohms at the center junction. With four pairs of conductive paths, each path may present a 200 ohm impedance at the junction so that the combiner network 40 provides a combined effective impedance of 50 ohms at the output of the combiner network 40.

At an outlying end of each conductive path 26 adjacent an active antenna element 30, impedance matching may also be provided to match the impedance of the active antenna element 30, which is typically 35 ohms for a quarter wavelength monopole antenna element, to the conductive path. This can be provided by a network, a quarter wavelength transmission line, or other impedance matching components as readily appreciated by those skilled in the art.

Figure 4:
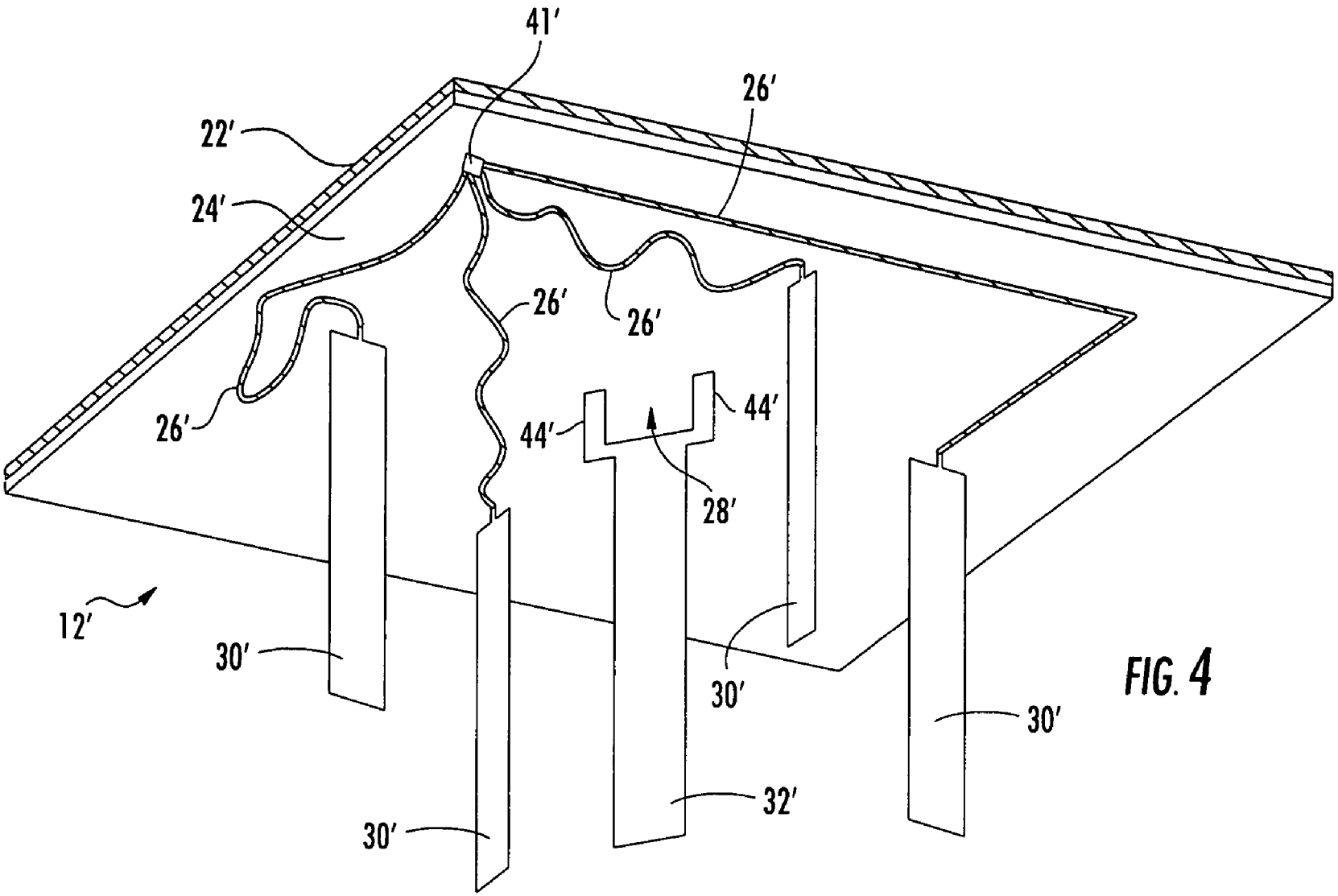
FIG. 4 is a perspective view of another embodiment of a ceiling mounted access point antenna without the radome in accordance with the present invention.

Referring now to FIG. 4, another embodiment of the ceiling mounted access point antenna 12' will be discussed. In this embodiment, the combiner network 40' is off-centered about the common area 28' so that a distance between the combiner network and each respective active antenna element is different. To maintain the same phase and amplitude of the RF signals received by the combiner network 40' from the conductive elements 30, as well as the same phase and amplitude of the RF signals received by the conductive antenna elements from the combiner network, a length of each conductive path 26' is equal to the length of the other conductive paths.

Figure 5A:
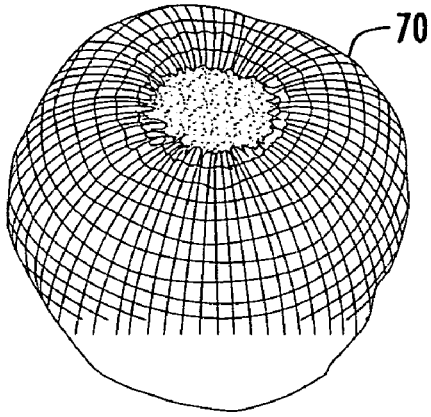
FIGS. 5*a*, 5*b* and 5*c* are respectively a 3-dimensional plot, and a set of azimuth and elevation radiation patterns at 2.450 GHz for a ceiling mounted access point antenna in accordance with the present invention.
Figure 5B:
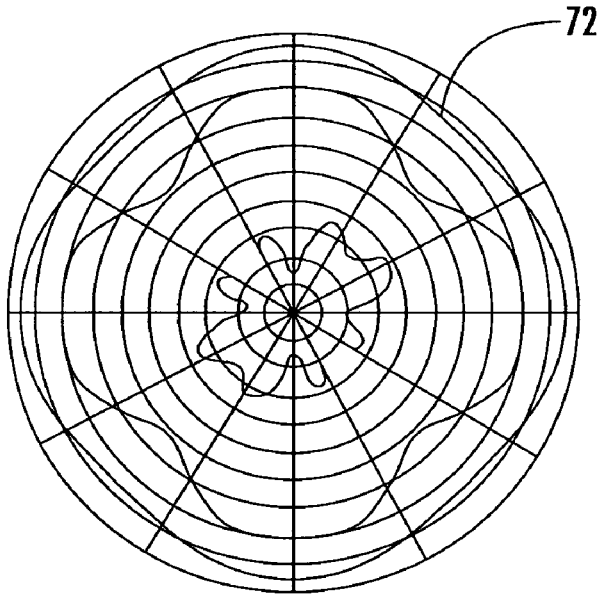
Figure 5C:
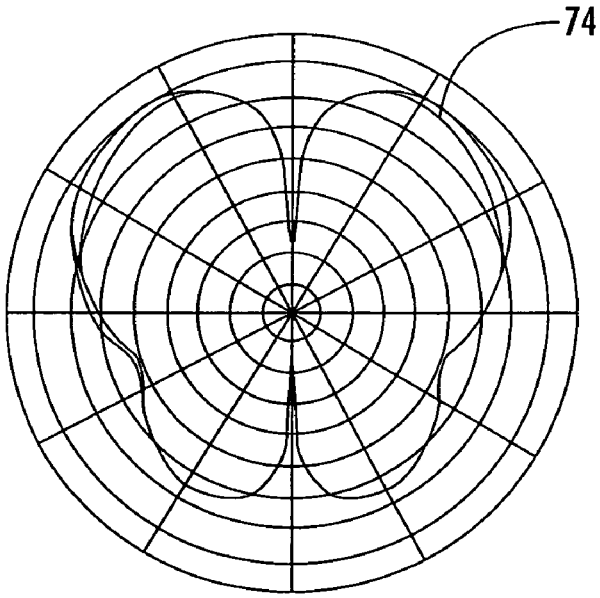

A 3-dimensional plot as well as a set of azimuth and elevation radiation patterns at 2.450 GHz for the access point antenna 12 are provided in FIGS. 5*a*, 5*b* and 5*c*. The simulations were performed with a finite element model that was derived using a high frequency structure simulator (HFSS) tool. The illustrated 3-dimensional plot 70 is provided by the HFSS model. Since the illustrated access point antenna 12 is ceiling mounted, this type of mounting configuration results in a down tilt of the antenna beam to radiate more efficiently toward the client stations 18, as indicated by plot 70 for azimuth and plot 72 for elevation. In other words, the beam peak is tilted away from the ground plane 22.

Figure 6:
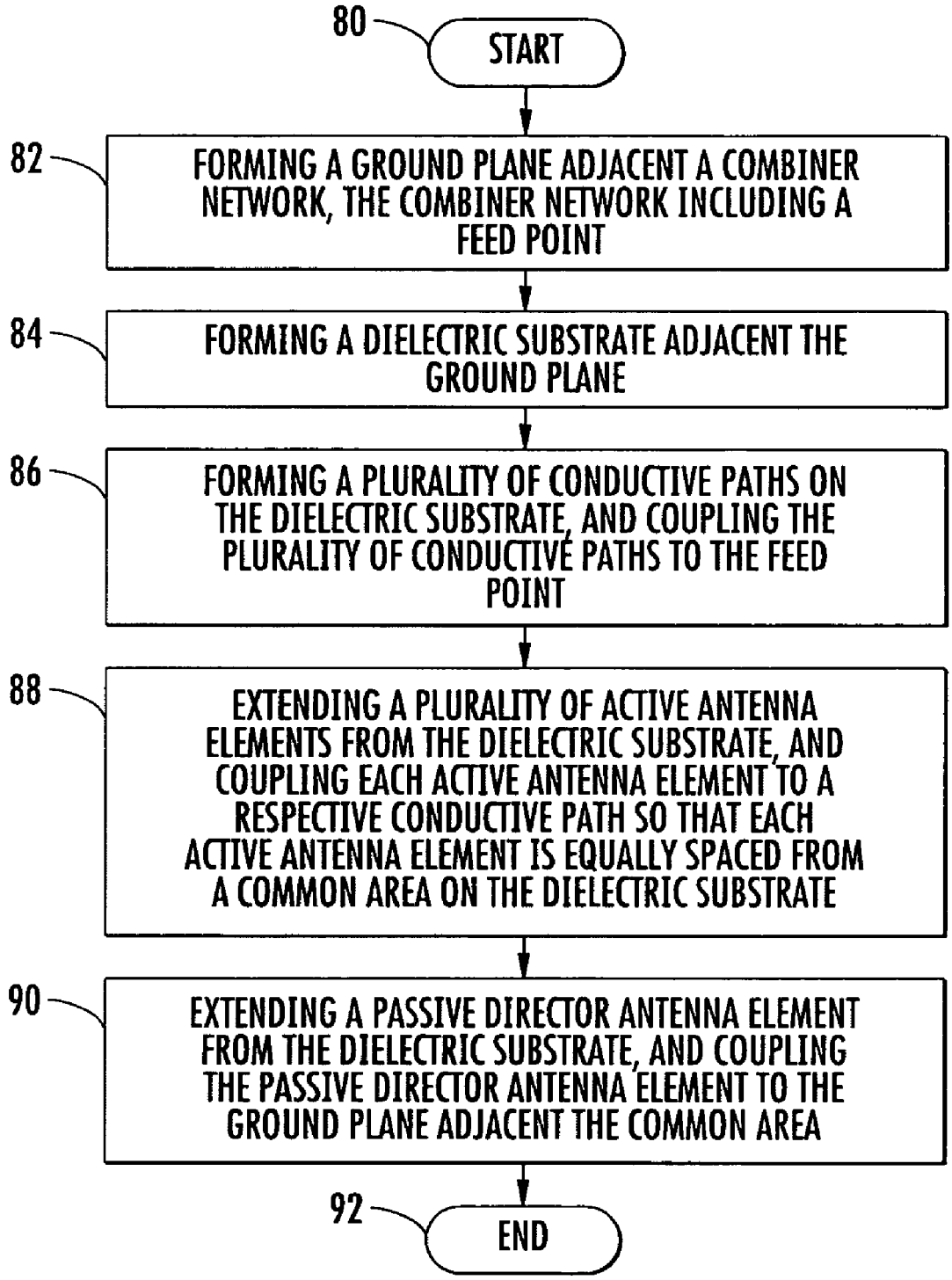
FIG. 6 is a flowchart for making an access point antenna in accordance with the present invention.

A method for making an access point antenna 12 for a wireless local area network 10 will now be discussed with reference to the flowchart in FIG. 6. From the start (Block 80), the method comprises forming a ground plane 22 adjacent a combiner network 40 at Block 82, wherein the combiner network includes a feed point 41.

A dielectric substrate 24 is formed adjacent the ground plane 22 at Block 84. A plurality of conductive paths 26 are formed on the dielectric substrate 24, and are coupled to the feed point 41 at Block 86. The method further comprises extending a plurality of active antenna elements 30 from the dielectric substrate 24, and coupling each active antenna element to a respective conductive path 26 so that each active antenna element is equally spaced from a common area 28 on the dielectric substrate at Block 88. A passive director antenna element 32 extends from the dielectric substrate 24, and is coupled to the ground plane 22 adjacent the common area 28 at Block 90. The method ends at Block 92.

Many modifications and other embodiments of the invention will come to the mind of one skilled in the art having the benefit of the teachings presented in the foregoing descriptions and the associated drawings. For example, the antenna as disclosed herein is not limited to an access point for a WLAN. For instance, the antenna may be connected to a client station via a USB interface, for example, so that the client station may be able to transmit and receive RF signals. Therefore, it is understood that the invention is not to be limited to the specific embodiments disclosed, and that modifications and embodiments are intended to be included within the scope of the appended claims.

That which is claimed is:

1. An access point antenna for a wireless local area network (WLAN) comprising:

a combiner network including a feed point;

a ground plane adjacent said combiner network;

a dielectric substrate adjacent said ground plane;

a plurality of conductive paths on said dielectric substrate and coupled to said feed point;

a plurality of active antenna elements extending from said dielectric substrate, each active antenna element coupled to a respective conductive path and being equally spaced from a common area on said dielectric substrate; and a single passive director antenna element extending from said dielectric substrate and coupled to said ground plane, and centered about the common area for reflecting RF energy away from the common area when said plurality of active antenna elements are transmitting in order to provide an omni-directional transmit pattern.

2. An access point antenna according to claim 1 wherein said combiner network is centered about the common area so that a distance between said combiner network and each respective active antenna element is the same.

3. An access point antenna according to claim 2 wherein said plurality of conductive paths extend radially from said combiner network, and a length of each conductive path is equal to the length of the other conductive paths.

4. An access point antenna according to claim 1 wherein said combiner network is off-centered about the common area so that a distance between said combiner network and each respective active antenna element is different.

5. An access point antenna according to claim 4 wherein a length of each conductive path is equal to the length of the other conductive paths.

6. An access point antenna according to claim 1 wherein said plurality of active antenna elements are angularly spaced from the common area at equal angles.

7. An access point antenna according to claim 1 wherein said plurality of active antenna elements are arranged as opposing pairs about the common area; and wherein said passive director antenna element bisects angles of the opposing pairs of active antenna elements.

8. An access point antenna according to claim 1 wherein said passive director antenna element and each active antenna element are orthogonal to said dielectric substrate.

9. An access point antenna according to claim 1 wherein each active antenna element comprises a blade antenna element oriented along a radius thereof toward the common area.

10. An access point antenna according to claim 1 wherein said plurality of active antenna elements are sized so that the access point antenna is operable over a frequency range of 2.3 to 2.5 GHz.

11. An access point antenna according to claim 1 wherein said plurality of active antenna elements are sized so that the access point antenna is operable over a frequency range of 4 to 6 GHz.

12. An access point antenna according to claim 1 wherein said plurality of active antenna elements and said passive director antenna element are sized and spaced apart from one another so that the access point antenna has a gain within a range of 3.5 to 5.0 dBi.

13. An access point antenna according to claim 1 wherein said dielectric substrate comprises a printed circuit board.

14. An access point antenna according to claim 1 wherein said plurality of conductive paths comprise at least one of a plurality of microstrips and a plurality of co-planar waveguides.

15. An access point antenna according to claim 1 wherein said plurality of active antenna elements comprise 4 active antenna elements spaced at 90 degree intervals.

16. An antenna comprising:

a combiner network including a feed point;

a ground plane adjacent said combiner network;

a dielectric substrate adjacent said ground plane;

a plurality of conductive paths on said dielectric substrate and coupled to said feed point;

a plurality of active antenna elements extending from said dielectric substrate, each active antenna element coupled to a respective conductive path and being equally spaced from said combiner network; and a single passive director antenna element extending from said dielectric substrate and coupled to said ground plane, and centered over said combiner network for reflecting RF energy away from said combiner network when said plurality of active antenna elements are transmitting in order to provide an omni-directional transmit pattern.

17. An antenna according to claim 16 wherein said plurality of conductive paths extend radially from said combiner network, and a length of each conductive path is equal to the length of the other conductive paths.

18. An antenna according to claim 16 wherein said plurality of active antenna elements are angularly spaced from said combiner network at equal angles.

19. An antenna according to claim 16 wherein said plurality of active antenna elements are arranged as opposing pairs about said combiner network; and wherein said passive director antenna element bisects angles of the opposing pairs of active antenna elements.

20. An antenna according to claim 16 wherein said passive director antenna element and each active antenna element are orthogonal to sad dielectric substrate.

21. An antenna according to claim 16 wherein each active antenna element comprises a blade antenna element oriented along a radius thereof toward said combiner network.

22. An antenna according to claim 16 wherein said plurality of active antenna elements are sized so that the antenna is operable over a frequency range of 2.3 to 2.5 GHz.

23. An antenna according to claim 16 wherein said plurality of active antenna elements are sized so that the antenna is operable over a frequency range of 4 to 6 GHz.

24. An antenna according to claim 16 wherein said plurality of active antenna elements and said passive director antenna element are sized and spaced apart from one another so that the antenna has a gain within a range of 3.5 to 5.0 dBi.

25. An antenna according to claim 16 wherein said dielectric substrate comprises a printed circuit board.

26. An antenna according to claim 16 wherein said plurality of conductive paths comprise at least one of a plurality of microstrips and a plurality of co-planar waveguides.

27. An antenna according to claim 16 wherein the teed point is configured to be coupled to a distribution system of a wireless local area network so that the antenna functions as an access point antenna.

28. An antenna according to claim 16 further comprising a transceiver coupled to the feed point that the antenna functions as a repeater.

29. A method for making an antenna comprising:

forming a ground plane adjacent a combiner network, the combiner network including a feed point;

forming a dielectric substrate adjacent the ground plane;

forming a plurality of conductive paths on the dielectric substrate, and coupling the plurality of conductive paths to the feed point;

extending a plurality of active antenna elements from the dielectric substrate, and coupling each active antenna element to a respective conductive path so that each active antenna element is equally spaced from a common area on the dielectric substrate; and extending a single passive director antenna element from the dielectric substrate, with the passive director antenna element being centered over the common area for reflecting RF energy away from the common area when the plurality of active antenna elements are transmitting in order to provide an omni-directional transmit pattern.

30. A method according to claim 29 wherein the combiner network is centered about the common area so that a distance between the combiner network and each respective active antenna element is the same.

31. A method according to claim 30 wherein the plurality of conductive paths extend radially from the combiner network, and a length of each conductive path is equal to the length of the other conductive paths.

32. A method according to claim 29 wherein the combiner network is off-centered about the common area so that a distance between the combiner network and each respective active antenna element is different.

33. A method according to claim 32 wherein a length of each conductive path is equal to the length of the other conductive paths.

34. A method according to claim 29 wherein the plurality of active antenna elements are angularly spaced from the common area at equal angles.

35. A method according to claim 29 wherein the plurality of active antenna elements are arranged as opposing pairs about the common area; and wherein the passive director antenna element bisects angles of the opposing pairs of active antenna elements.

36. A method according to claim 29 wherein the passive director antenna element and each active antenna element are orthogonal to the dielectric substrate.

37. A method according to claim 29 wherein each active antenna element comprises a blade antenna element oriented along a radius thereof toward the common area.

38. A method according to claim 29 wherein the plurality of active antenna elements are sized so that the antenna is operable over a frequency range of 2.3 to 2.5 GHz.

39. A method according to claim 29 wherein the plurality of active antenna elements are sized so that the antenna is operable over a frequency range of 4 to 6 GHz.

40. A method according to claim 29 wherein the plurality of active antenna elements and the passive director antenna element are sized and spaced apart from one another so that the antenna has a gain within a range of 3.5 to 5.0 dBi.

* * * * *

UNITED STATES PATENT AND TRADEMARK OFFICE

CERTIFICATE OF CORRECTION

PATENT NO. : 7,239,288 B2
APPLICATION NO. : 10/953893
DATED : July 3, 2007
INVENTOR(S) : Lynch et al.

It is certified that error appears in the above-identified patent and that said Letters Patent is hereby corrected as shown below:

| | |
|---|---|
| Column 7, Line 55 | Delete: "sad"<br>Insert: -- said -- |
| Column 8, Line 10 | Delete: "teed"<br>Insert: -- feed -- |

Signed and Sealed this

Fifth Day of August, 2008

JON W. DUDAS
*Director of the United States Patent and Trademark Office*